United States Patent [19]

Frechin

[11] 4,026,577

[45] May 31, 1977

[54] SELF-RESTORING SKI BINDING HAVING SINGLE TENSIONING MEANS

[75] Inventor: Jean-Paul Frechin, Chamonix, France

[73] Assignee: Garcia Corporation, Teaneck, N.J.

[22] Filed: June 6, 1975

[21] Appl. No.: 584,403

[30] Foreign Application Priority Data

June 14, 1974 France ..... 74.20825

[52] U.S. Cl. ..... 280/613; 280/637

[51] Int. Cl.[2] ..... A63C 9/08

[58] Field of Search ..... 280/637, 613

[56] References Cited

UNITED STATES PATENTS

| | | | |
|---|---|---|---|
| 3,822,070 | 7/1974 | Salomon | 280/637 |
| 3,871,674 | 3/1975 | Bunn, Jr. | 280/637 |
| 3,893,682 | 7/1975 | Weinstein et al. | 280/637 |
| 3,924,866 | 12/1975 | Schweizer | 280/637 |

FOREIGN PATENTS OR APPLICATIONS

| | | |
|---|---|---|
| 227,994 | 10/1943 | Switzerland |

*Primary Examiner*—Joseph F. Peters, Jr.
*Assistant Examiner*—Milton L. Smith
*Attorney, Agent, or Firm*—Fitzpatrick, Cella, Harper & Scinto

[57] ABSTRACT

A ski binding comprises a sole plate fixable under a boot sole, each end of the sole plate being held on a ski by a flexible cable under the action of a single tensioning device lodged in the sole plate. The cable passes about pulleys of said device, at least one of the pulleys being movable against the action of spring means to allow separation of the sole plate from the ski by withdrawal of cable.

6 Claims, 15 Drawing Figures

SELF-RESTORING SKI BINDING HAVING SINGLE TENSIONING MEANS

The invention relates to ski bindings, in particular bindings of the type comprising a sole plate fixable to a ski boot sole, in which each end of the sole plate is held against a ski by a flexible connection or cable permanently tensioned by elastic means.

In a known binding of this type, sold under the Trademark "Burt", each cable is tensioned by a separate spiral spring winder having an independent setting device. Such bindings are thus complex and have a large number of component parts. Also, the two springs cannot be adjusted simultaneously.

An object of the invention is to provide a binding of the stated type of simpler construction and lighter than the known ones. A further object is to simplify setting and enable simultaneous regulation of the release effort for each end of the sole plate, by arranging for a constant ratio between the release efforts for the two ends. A subsidiary object is to provide embodiments of the binding for which the retaining effort is such that after a certain predetermined force required for release, the retaining effort drops abruptly to allow rapid separation of the sole plate from the ski, this effort however being sufficient to automatically bring the ski firmly back under the sole plate when the force that produced separation ceases.

A security ski binding according to the invention comprises a single cable tension device comprising at least one movable element, two cable-tensioning parts cooperating with at least one flexible cable, at least one of said cable-tensioning parts being kinematically connected to a said movable element, and means for elastically biasing said at least one movable element to hold said at least one cable under tension.

In the case where there are two separate flexible cables for holding respective ends of the sole plate, an end of each cable is attached to the respective cable tensioning part, which may be rotatably mounted. In the case of a single cable, a part of the cable is wound about the two cable tensioning parts which may be pulleys or other rotatably mounted parts.

It is of course understood that the terms cable and flexible connection as used herein are meant to include all suitable flexible strands, cords, wires and other substantially non-extensible flexible elongate members.

In certain embodiments, the movable element is a rotatably mounted support on which the two cable tensioning pulleys or parts are disposed in substantially diametrically opposed positions and on substantially the same plane. The accompanying drawings show, by way of example, several embodiments of the invention.

Figure 1:
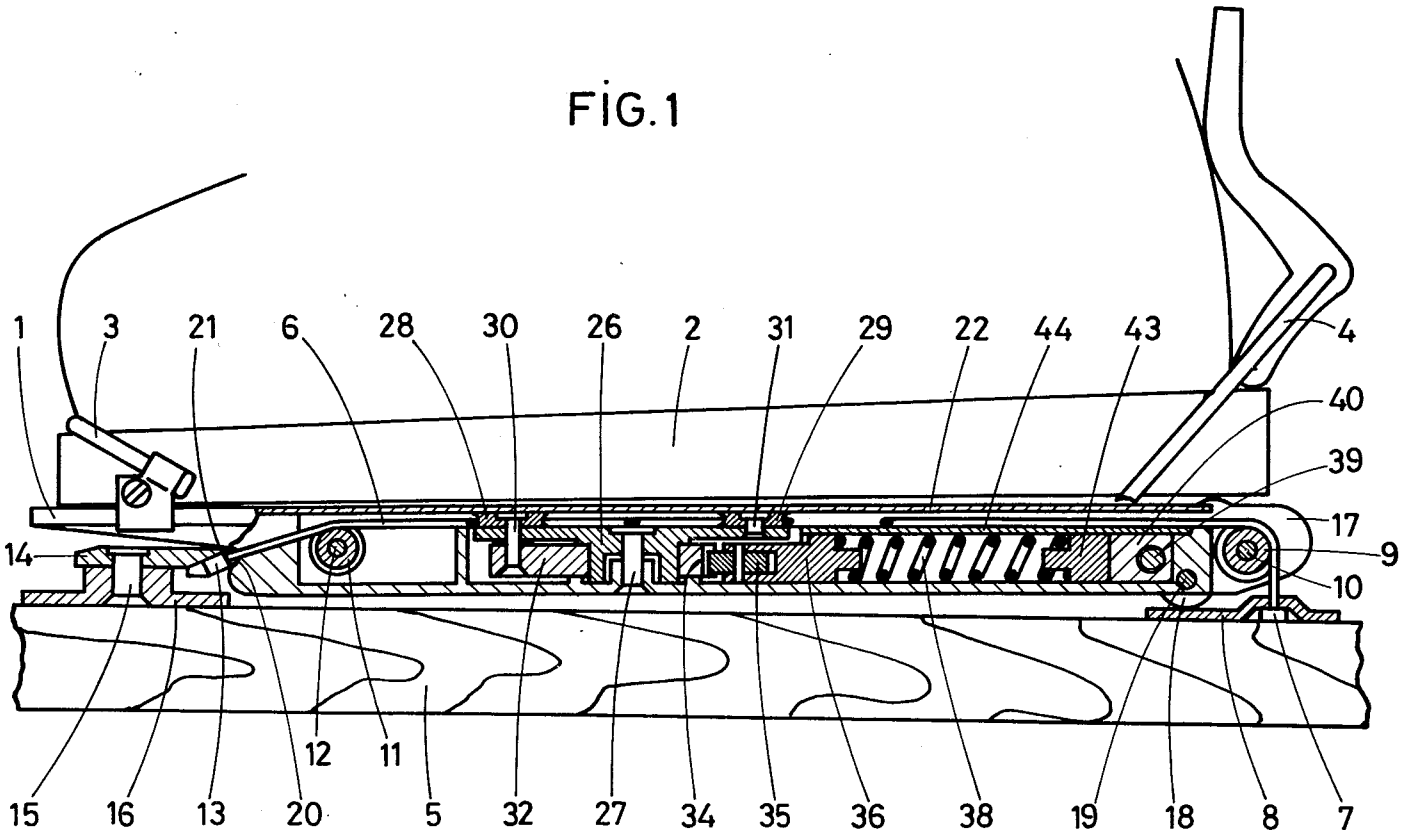
FIG. 1 is a longitudinal cross-section, taken along line I—I of FIG. 2, of a first embodiment of binding mounted on a ski, and holding a boot in place.
Figure 2:
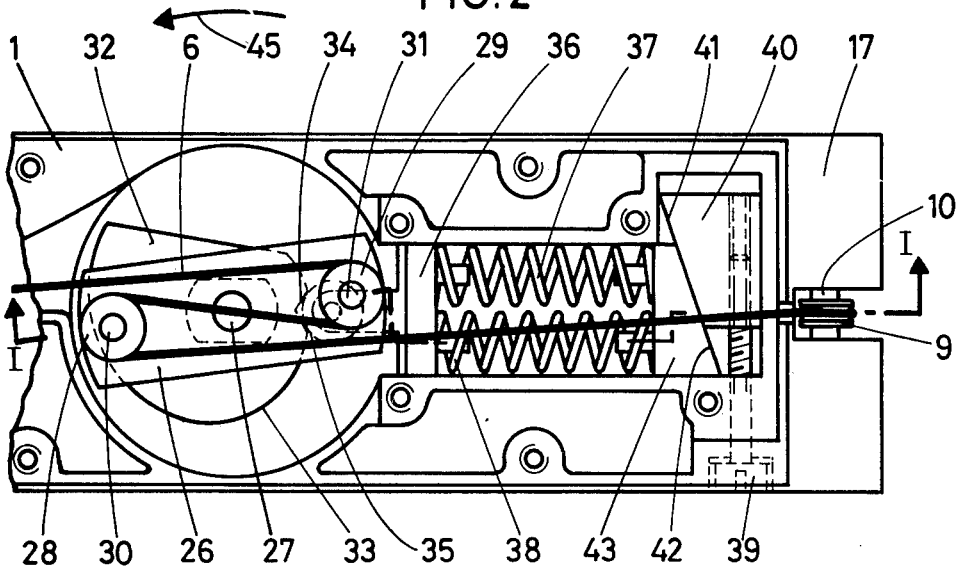
FIGS. 2 and 3 are top plan views of part of the binding of FIG. 1, shown with the cover plate removed, and respectively in a retaining and a release position.
Figure 3:
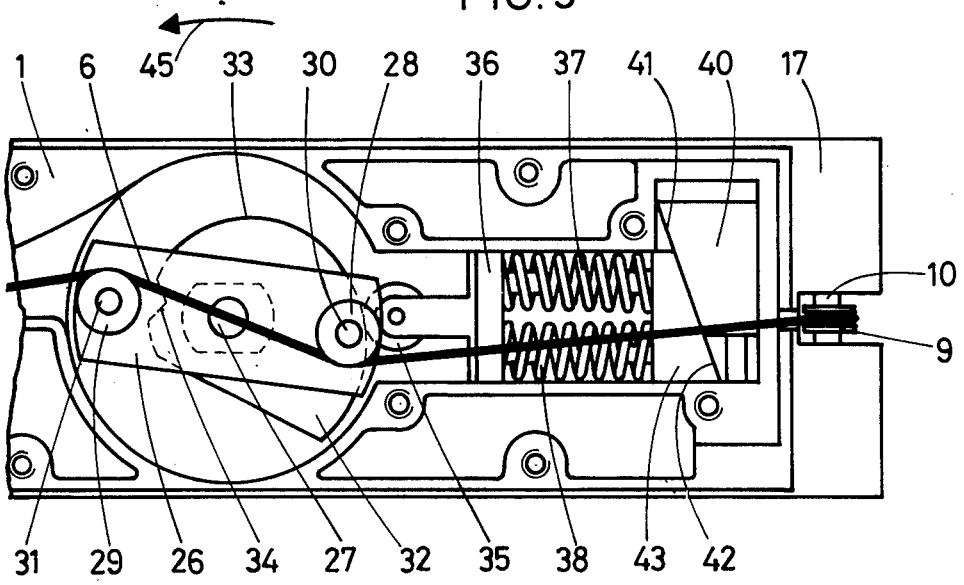
Figure 7:
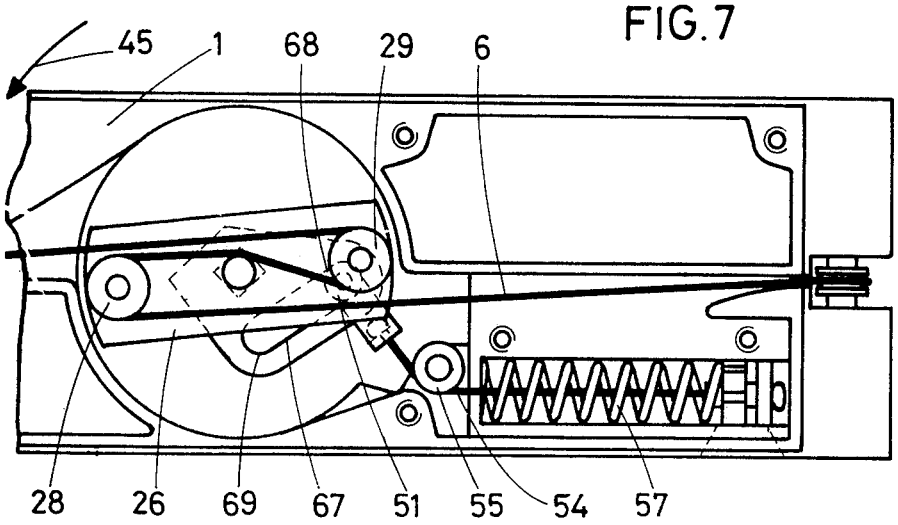
Figure 9:
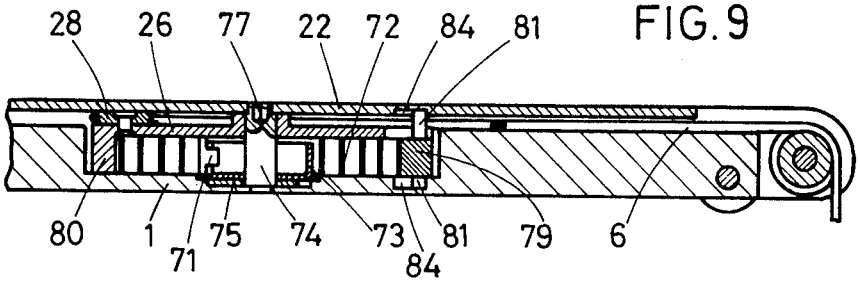
Figure 10:
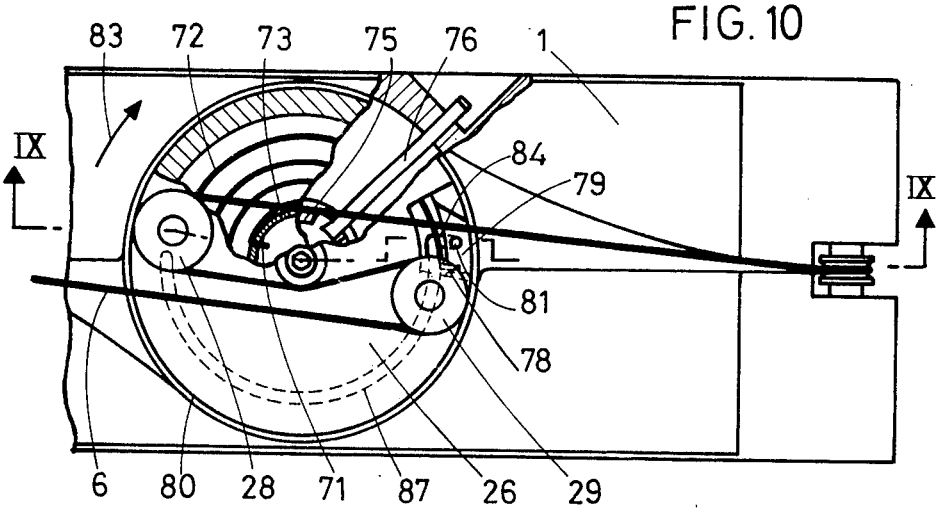
Figure 11:
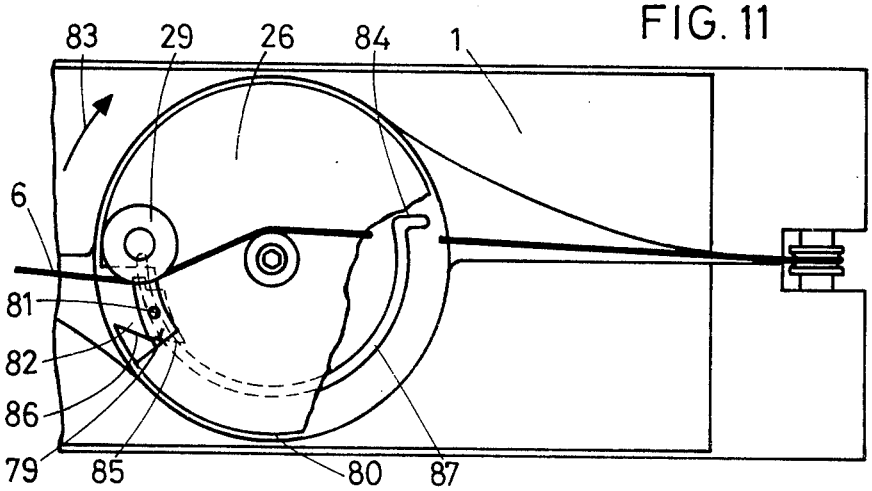

FIGS. 7 an 8 are similar views of a third embodiment;

FIG. 9 is a cross-section taken along line IX—IX of FIG. 10, of a fourth embodiment of binding;

FIGS. 10 and 11 are plan views corresponding to FIGS. 3 and 3 of the fourth embodiment, but with parts cut away and shown in cross-section;

FIGS. 12 to 15 are partial views showing different phases of operation of the fourth embodiment;

The first embodiment shown in FIGS. 1 to 3 comprises a hollow sole-plate 1 able to be secured under a boot sole 2 by a toe retaining member 3 and a heel retaining member 4. A single flexible cable 6 permanently tensioned by a single tensioning device which will be described later constantly tends to hold both ends of plate 1 down against a ski 5. The rear end 7 of cable 6 is fixed to ski 5 by a plate 8 screwed on the ski. From this end, cable 6 passes over a pulley 9 rotatably mounted on a shaft 10 fixed in a cut-out in plate 1, then cooperates with the single tensioning device, passes over a second pulley 11 rotatably mounted on a shaft 12 fixed in plate 1, and is finally secured by its front end 13 to a turning element 14 supported by a shaft 15 held on ski 5 by a securing plate 16. The rear part 17 of plate 1 included downwardly-projecting projecting roller 18 pivoted at 19, these rollers bearing on plate 8 when the binding is "closed". The front part of plate 1 has a profiled part 20 of complementary profile to and cooperating with the edge 21 of element 14, to hold plate 1 on ski 5 when the binding is closed. A cover 22 closes the housing in plate 1 in which the single tensioning device is placed.

When the boot exerts on the front of plate 1 a predetermined minimum upwardly-directed or transverse force, the plate 1 moves slightly rearwardly, by rolling on rollers 18, and its profiled part 20 disengages from the edge 21 of element 14. The single tensioning device then releases a given length of cable 6 to allow the boot and plate 1 to separate from the ski, the ski automatically returning to its initial position applied under plate 1 when said upward or transverse force on the boot ceases.

When the boot exerts on the rear of plate 1 a minimum predetermined upwardly-directed or transverse force, plate 1 lifts up (and/or pivots about 15) relative to the ski, the single tensioning device releasing a certain length of cable 6 so that the boot and plate 1 may separate from ski 5. The ski automatically returns to its initial position applied under plate 1 when said upward or transverse force on the boot ceases.

The above description applies to all of the described embodiments.

In the first embodiment, FIGS. 1 to 3, the tensioning device includes a support 26 rotatably mounted on a shaft 27 fixed on plate 1. Two pulleys 28,29 are rotatably mounted about respective shafts 30,31 at opposite ends of support 26 in diametrically opposed positions about shaft 27. A cam 32 secured for rotation with support 26 and having a V-notch 34 and a cam surface 33, constantly bears against a roller 35 rotatably mounted on a piston 36 permanently urged by two compression springs 37 and 38. The radius of surface 33 progressively increases from notch 34, which engages with roller 35 in the closed or rest position of the binding, up to the point of surface 33 which engages roller 35 in the release position of the binding (FIG. 3). The pressure of springs 37, 38 is adjustable by means of a transverse screw 39 the rotation of which moves a wedge-shaped nut 40 along the axial direction of the screw. An inclined face 41 of nut 40 cooperates with a corresponding inclined face 42 of a wedge 43 to move it perpendicular to nut 40, the wedge 43 serving as a support for the ends of springs 37,38. A cover 44 (removed from FIGS. 2 and 3) is placed over springs 37,38 and their adjusting device. Cable 6 is wound about pulleys 28,29 of the tensioning device as shown in FIGS. 2 and 3.

When a force on the boot tends to separate plate 1 from the ski 5, the roller 35 engaging in notch 34 firstly opposes rotation of support 26, and hence a withdrawal of cable 6 which would permit plate 1 to move away from ski 5. When the force exceeds a predetermined minimum value, roller 35 is pushed back by an edge of notch 34 and the support 26 is rotated in direction 45 against the action of springs 37 and 38 which urge roller 35 against cam profile 33. The various elements thus move to the position of FIG. 3 in which the extra available length of cable 6 allows plate 1 to remain away from ski 5.

Figure 4:
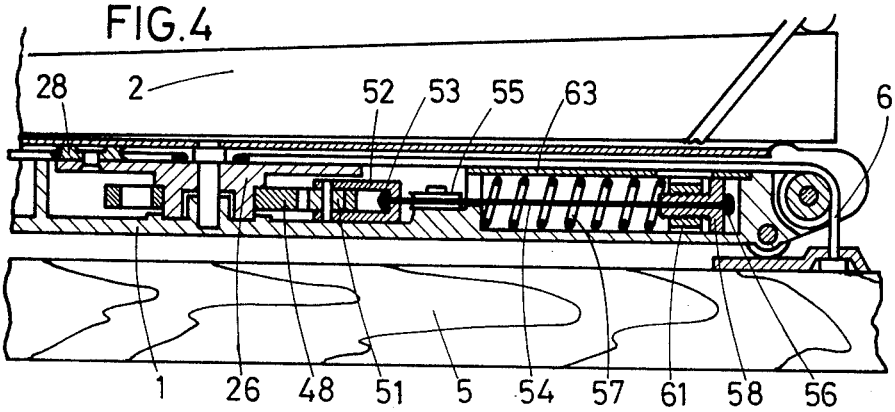
FIG. 4 is a cross-section, taken along line IV 13 IV of FIG. 5, of part of a second embodiment of binding mounted on a ski and holding a boot in place.
Figure 5:
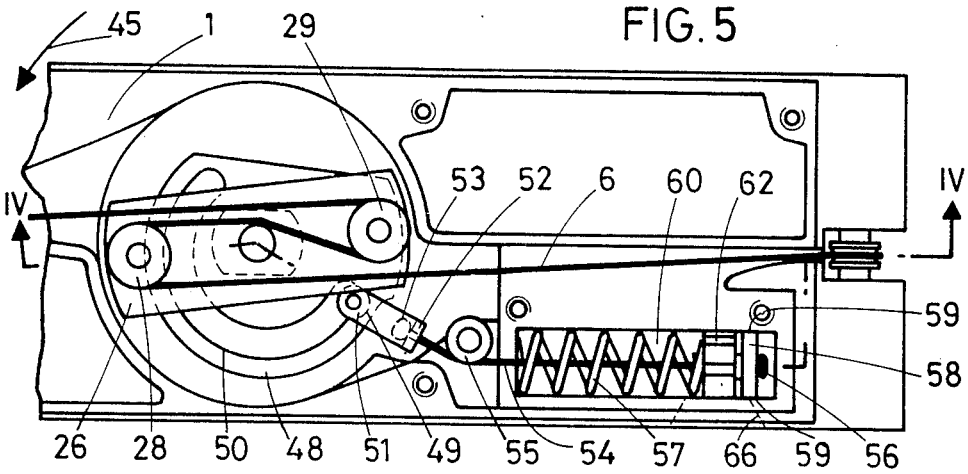
FIGS. 5 and 6 are views corresponding to FIGS. 2 and 3 of the second embodiment.
Figure 6:
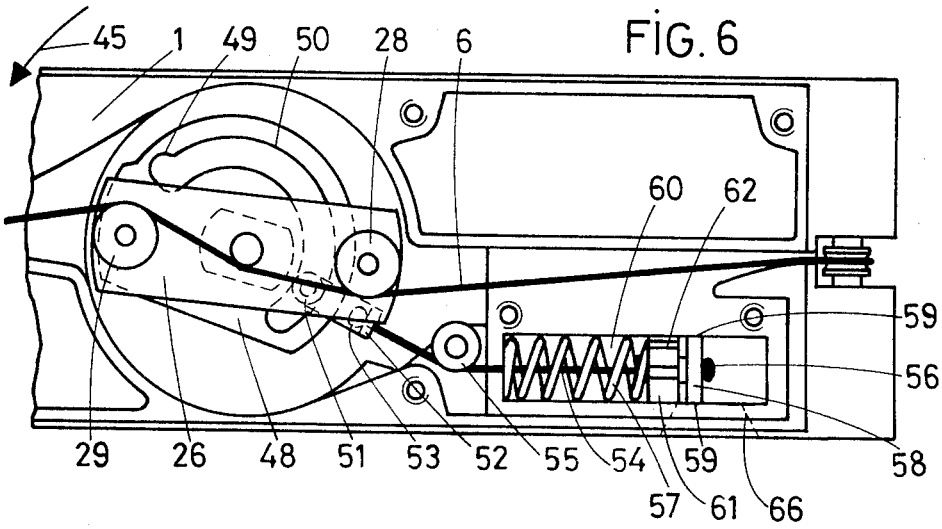

During the initial part of rotation of support 26 and cam 32, the angular displacement of pulleys 28,29 tends to reduce the tension of cable 6, whereas the increase in the effective radius of cam surface 33 tends to increase the tension; by choice of the cam surface 33 it is thus possible to obtain a curve of the retaining force which, after having passed a maximum value while roller 35 is pushed back by the face of notch 34, abruptly drops and then increases slightly, remains constant, or decreases slightly. The binding returns to the rest position of FIG. 2 as soon as the force exerted on the boot ceases. Rotation of screw 29 enables setting of the minimum force above which the sole plate 1 is freed from ski 5. The pressure actuated roller 35 may, as shown in FIGS. 4 to 6, be replaced by a similar system operating by tension. In this second embodiment, the tensioning device is formed, as in the first embodiment, by rotatable support 26 carrying two pulleys 28,29. A cam 48 is keyed for rotation with support 26, the cam having a profile including a notch 49 extended by a groove with an eccentric curved surface 50 the operative radius of which decreases as support 26 passes from the rest position (FIG. 5) to the release positon (FIG. 6). A roller 51 constantly applied against this profile is rotatably mounted on a joke 52 in which an enlarged end 53 of a cable 54 is held. Cable 53 is guided by a pulley 55 and its second end 56 held by a spring 57 by means of a device for adjusting the pressure of this spring. This device includes a screw 58 to which end 56 is hooked, and which is slidably but not rotatably mounted in a housing 60 by means of flats 59. Screw 59 carries a nut 61 against which the end of spring 57 bears. Nut 61 has notches 62 enabling it to be rotated to adjust the pressure of spring 57. A window 66 is provided in the lateral face of plate 1 to allow access for this adjustment, and a cover 63 (removed from FIGS. 5 and 6) is fitted on housing 60. All of the other elements are identical to those of the previous embodiment.

When a force on boot 2 tends to separate plate 1 from ski 5, roller 51 initially in the rest position (FIG. 5) engaging in notch 49 only allows a very slight rotation of support 26, and hence a slight effective extension of cable 6. When the force on the boot reaches a preset minimum value, roller 51 disengages from notch 49 and support 26 is rotated in direction 45 against the action of spring 57 which pulls roller 51 against surface 50 of cam 48. The various parts thus move to the position of FIG. 6, in which the cable 6 is fully wound out to allow separation of plate 1 from ski 5.

During the initial part of rotation of support 26 and cam 48, the angular displacement of pulleys 28 and 29 tends to reduce the tension of cable 6 whereas reduction of the effective radius of surface 50 tends to simultaneously increase the tension of cable 6, by a lesser degree. The surface 50 can thus be arranged to provide a curve of the retaining force which, after having a passed through a maximum value while roller 51 is engaged in notch 49, abruptly drops and then decreases slightly.

Figure 8:
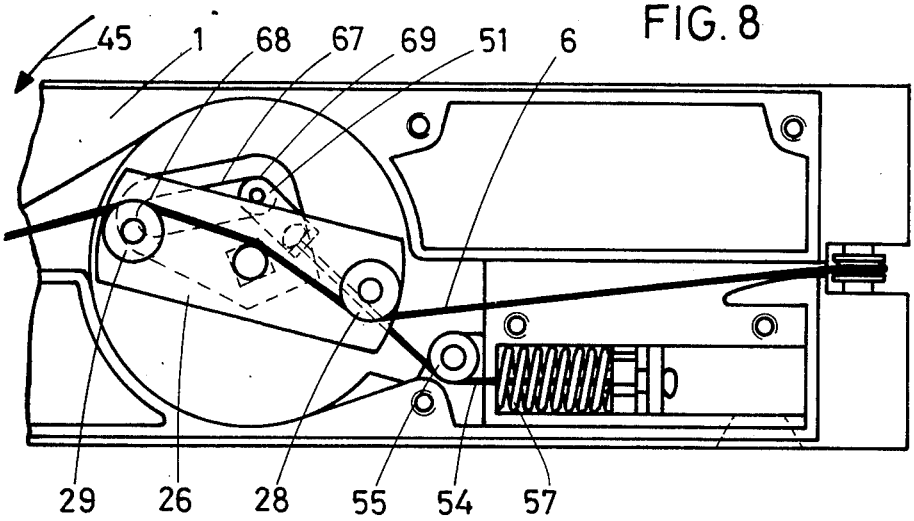

In the third embodiment, FIGS. 7 and 8, the tensioning device differs from that of the second embodiment solely in that cam 48 with notch 49 and surface 50 is replaced by a rectilinear guide slot 67 of which one end 68 is further away from the axis of rotation of support 26 than its other end 69. The previously described roller 51 is lodged in this guide slot along which it can move. All of the other elements are the same as for the second embodiment.

When a force on boot 2 tends to separate plate 1 from ski 6, the roller 51 which, in the initial rest positon (FIG. 7) is in contact with end 68 of slot 67, exerts and opposing force which increases rapidly up to the moment when the support 26 having rotated by a certain amount in direction 45, the longitudinal axis of slot 67 is perpendicular to an axis through the shaft of roller 51 and the point of contact of cable 54 of pulley 55. From this moment, roller 51 starts to roll along slot 67 until after a further rotation of support 26, it abuts against end 69. The roller 51 then remains in this position during the remainder of the rotation of support 26 which finally arrives in the position of FIG. 8 in which the fully wound out cable 6 allows separation of plate 1 from the ski.

With this arrangement, the curve of the retaining force is substantially the same as for the second embodiment.

The tension actuated roller 51 of the third embodiment, forming a piece for the transmission of the spring force, could be replaced by a pressure urged piston, cooperating with an appropriately positioned slot or other guide.

In the fourth embodiment, FIGS. 9 to 15, the tensioning device is, as before, formed by a rotatable support carrying two pulleys 28, 29. However, support 26 is biased by a spiral spring 72 having one end attached to a rim 73 keyed on a rotatable shaft 74 on which the support 26 is freely rotatably mounted. A toothed part 75 fixed to rim 73 cooperates with a sliding piece 76 to hold the rim 73 angularly fixed, and hence set the degree of winding of spring 72, By temporarily disengaging piece 76 from the toothed part 75, the degree of winding of spring 72 can be set by turning shaft 74 by engaging an Allen key in a polygonal recess 77 (FIG. 9) in the accessible upper end of shaft 74. The outer end 78 of spring 72 is hooked in a piece 79 mounted on support 26 for a limited radial and circumferential movement in an opening 82 in the periphery of support 26 and in a cylindrical barrel 80 integral with support 26, this barrel 80 being concentric to shaft 74 and housing spring 72. Piece 79 carries a protruding pin 81 which, in the rest position is outwardly pushed by spring 72 in like grooves 84 disposed in the bottom of plate 1 and in cover 22 substantially radial to barrel 80. Piece 79 and barrel 80 have cooperating facing ramps 85,86 respectively, arranged to radially inwardly move piece 79 and its pin 81 when suport 26 is rotated in direction 83 against the action of spring 72, while piece 79 is angularly locked by the engagement of pins 81 in grooves 84. At their innermost ends, grooves 84 are extended by arcuate grooves 87 concentric to shaft 74 and extending over about a semi-circle. Cable 6 is wound about pulleys 28 and 29 as shown in FIGS. 10 and 11.

Figure 12:
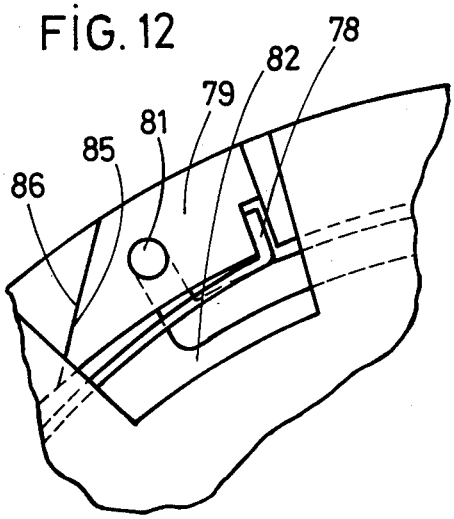
Figure 13:
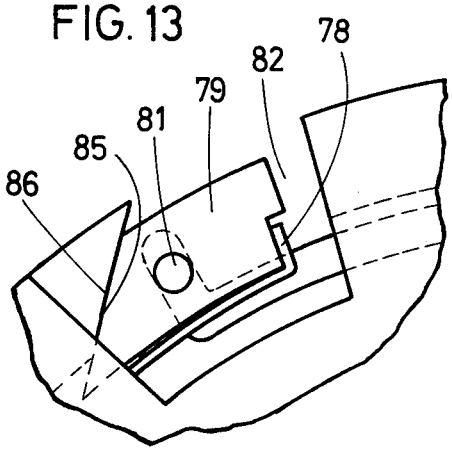

When a force on the boot tends to separate plate 1 from ski 5, support 26 and its integral barrel 80 are rotatably driven in direction 83 from the rest position shown in FIGS. 10 and 12. In a first phase, ramp 86 acting against ramp 85 inwardly displaces piece 79 radially relative to barrel 80, successively to the positions of FIGS. 13 and 14, until pin 81 engages the inner end of grooves 84, adjacent grooves 87. Piece 79 and pin 81 are then pushed by barrel 80, against the action of spring 72, in direction 83 along grooves 87, as shown in FIG. 15. After about half a turn, support 26 arives in the position of FIG. 11 in which cable 6 is fully wound out and allows plate 1 to be separated from the ski.

Figure 14:
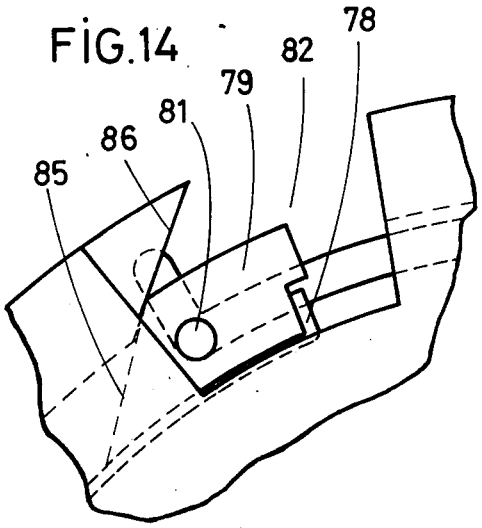
Figure 15:
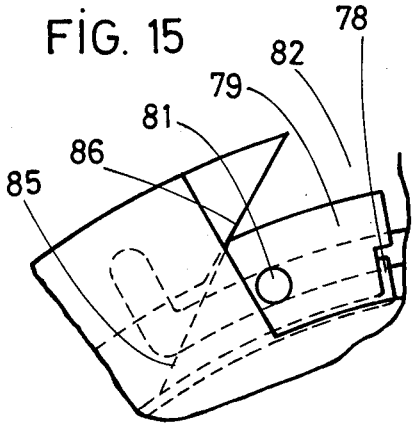

At the beginning of rotation of suport 26 and barrel 80 (FIGS. 13 and 14), the angular displacement of pulleys 28 and 29 tends to slightly rreduce the tension of cable 6, whereas simultaneously the resistance provided by ramp 85 tends to greatly increase the tension of cable 6 up to the moment when pin 81 arrives in the position of FIG. 14 and the support 26 is driven against the action of spring 72. Selection of the inclination of ramps 85,86 hence enables the obtention of various curves of the retaining force which after having passed a maximum value while ramp 85 slides on ramp 86, abruptly drops and then remains substantially constant.

In the case where the single cable passing about two pulleys or other rotatable or non rotatable bearing parts is replaced by two distinct cables, both of the cable tensioning parts cooperating with the cables must in principle be movable to enable both ends of the sole plate to be releasable.

Instead of being housed in the sole plate, the single tensioning device of the release mechanism could be housed in a casing fixed on the ski.

Also, a single cable could be wound about more than two rollers or other cable-tensioning parts.

What is claimed is:

1. In a releasable ski binding comprising a sole plate, means for releasably securing a ski boot to said sole plate, at least one flexible cable housed within said sole plate to extend from opposite ends thereof, the ends of said cable being secured to the surface of ski to permit release of said sole plate from said ski upon application of a minimum release force and automatic return of said plate to said ski upon abatement of said force, an improved means for continuously tensioning said cable comprising:

a single support rotatably mounted within said sole plate;

a pair of cable engaging elements mounted to said support in substantially the same plane and in diametric positions, said support and cable engaging elements being rotatable between a first position wherein the length of said cable is reduced and a second position wherein the length of said cable is increased; and biasing means housed within said sole plate and arranged to continuously urge said rotatable support into said first position.

2. A binding according to claim 1, in which said biasing means comprises a cam mounted for rotation with said support, spring means, and a member coacting with sais cam under the action of said spring means.

3. A binding according to claim 2, wherein said cam has an operative radius about the axis of said rotatable support which increases as said support moves from said first to said second position, said spring means is at least one compression spring, and said coacting member is constructed and arranged to engage said radius and compress said spring as said support rotates from said first to said second position.

4. A binding according to claim 2, wherein said can has an operative radius about the axis of said rotatable support which decreases as said support moves from said first to said second position, said spring means is at least one compression spring, and said coacting member is constructed and arranged to engage said radius and compress said spring as said support rotates from said frist to said second position.

5. A binding according to claim 1, in which said biasing means comprises a member arranged for rotation with said support said member having an elongate guide having a first end and a second end spaced apart from the axis of said rotatable support by different distances, a transmission piece carried in said guide, and spring means acting on said transmission piece to bias said support to said first position, said transmission piece being slidable along said guide after a given rotation of said support away from said first position.

6. A binding according to claim 1, in which said biasing means comprises a spiral spring having an outer end secured to a member movably mounted in relation to said support, means defining a fixed guide groove including part disposed radially to the axis of said support and having outer and inner ends and a part concentric to said axis extending over approximately a semi-circle from said inner end of said radial part, a projection on said member engaged in said guide groove and being biased to the outer end of said radial part by said spiral spring to angularly lock said member, and cooperating complementary profiles on said member and said support for inwardly moving said member to said inner end of said radial part of the guide groove in response to rotation of said support against the action of said spiral spring to angularly free said member for angular movement thereof and said support with said projection passing along said concentric part of said guide groove.

* * * * *

UNITED STATES PATENT OFFICE

CERTIFICATE OF CORRECTION

Patent No. 4,026,577 Dated May 31, 1977

Inventor(s) JEAN-PAUL FRECHIN

It is certified that error appears in the above-identified patent and that said Letters Patent are hereby corrected as shown below:

Col. 6, line 11, "sais" should be --said--;

Col. 6, line 20, "can" should be --cam--;

Col. 6, line 27, "frist" should be --first--.

Signed and Sealed this second Day of August 1977

[SEAL]

Attest:

RUTH C. MASON
*Attesting Officer*

C. MARSHALL DANN
*Commissioner of Patents and Trademarks*